US008714720B2

(12) United States Patent
Malik et al.

(10) Patent No.: US 8,714,720 B2
(45) Date of Patent: May 6, 2014

(54) METALLIZED PRINT HEAD CONTAINER AND METHOD

(71) Applicant: Hewlett-Packard Development Company, L.P., Fort Collins, CO (US)

(72) Inventors: Craig L. Malik, Corvallis, OR (US); Mark A. DeVries, Albany, OR (US); Paul Mark Haines, Lebanon, OR (US); Ronald J. Ender, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/691,300

(22) Filed: Nov. 30, 2012

(65) Prior Publication Data

US 2013/0088552 A1 Apr. 11, 2013

Related U.S. Application Data

(62) Division of application No. 11/714,968, filed on Mar. 7, 2007, now abandoned.

(51) Int. Cl.
*B41J 2/175* (2006.01)

(52) U.S. Cl.
USPC ..... 347/86

(58) Field of Classification Search
USPC ..... 347/1, 20, 84, 85, 86
See application file for complete search history.

(56) References Cited

U.S. PATENT DOCUMENTS

| | | | | |
|---|---|---|---|---|
| 3,061,482 | A | | 10/1962 | Grant |
| 3,547,294 | A | | 12/1970 | Williams |
| 3,828,960 | A | | 8/1974 | Walles |
| 4,159,229 | A | * | 6/1979 | Donakowski et al. ..... 428/652 |
| 4,368,478 | A | | 1/1983 | Koto |
| 4,429,320 | A | | 1/1984 | Hattori et al. |
| 4,604,633 | A | | 8/1986 | Kimura et al. |
| 4,673,955 | A | | 6/1987 | Ameyama et al. |
| 4,803,094 | A | | 2/1989 | Myers |
| 5,134,046 | A | * | 7/1992 | Chow et al. ..... 429/176 |
| 5,419,139 | A | | 5/1995 | Blum et al. |
| 5,903,292 | A | | 5/1999 | Scheffelin et al. |
| 5,924,198 | A | | 7/1999 | Swanson et al. |
| 5,980,021 | A | | 11/1999 | Nagoshi et al. |
| 6,203,136 | B1 | | 3/2001 | Takahashi et al. |

(Continued)

FOREIGN PATENT DOCUMENTS

| | | |
|---|---|---|
| EP | 1281526 | 2/2003 |
| JP | 57083488 | 5/1982 |

(Continued)

*Primary Examiner* — Alessandro Amari
*Assistant Examiner* — Kendrick Liu

(57) ABSTRACT

An ink container for an inkjet print head includes a substantially rigid body of polymer material, the body including a base and a side wall integrally formed with the base at a perimeter of the base, the body containing ink in a low pressure chamber, and the polymer material having moderate to high air permeability. A flexible film is sealed over the low pressure chamber, inwardly flexible in response to a decrease in pressure and ink volume in the low pressure chamber, and outwardly flexible in response to an increase in pressure and ink volume in the low pressure chamber. A metal is coated on a perimeter of the polymer body and on an outer exposed surface of the flexible film, the metal to form a metal coating configured to decrease the air permeability of the polymer body, the metal coating being formed from at least copper.

20 Claims, 6 Drawing Sheets

(56) References Cited

U.S. PATENT DOCUMENTS

| | | | |
|---|---|---|---|
| 6,325,496 | B1 | 12/2001 | Kageyama et al. |
| 6,371,605 | B1 | 4/2002 | Komplin et al. |
| 6,378,971 | B1 | 4/2002 | Tamura et al. |
| 6,390,611 | B1 | 5/2002 | Kobayashi et al. |
| 6,431,692 | B1 | 8/2002 | Thielman et al. |
| 6,485,137 | B2 | 11/2002 | Karlinski et al. |
| 6,547,377 | B2 | 4/2003 | Thielman et al. |
| 6,863,387 | B2 | 3/2005 | Thielman et al. |
| 2001/0024225 | A1 | 9/2001 | Ishizawa et al. |
| 2001/0030021 | A1 | 10/2001 | Romig et al. |
| 2003/0067520 | A1 | 4/2003 | Inoue et al. |
| 2004/0223036 | A1* | 11/2004 | Inoue et al. ..... 347/85 |
| 2004/0239736 | A1* | 12/2004 | Miyazawa et al. ..... 347/86 |
| 2004/0252146 | A1* | 12/2004 | Naka et al. ..... 347/6 |
| 2006/0268082 | A1 | 11/2006 | Henricus |
| 2007/0171265 | A1 | 7/2007 | Hong et al. |

FOREIGN PATENT DOCUMENTS

| | | |
|---|---|---|
| JP | 59120481 | 12/1985 |
| JP | 60262652 | 12/1985 |
| JP | 2003/334963 | 11/2003 |

* cited by examiner

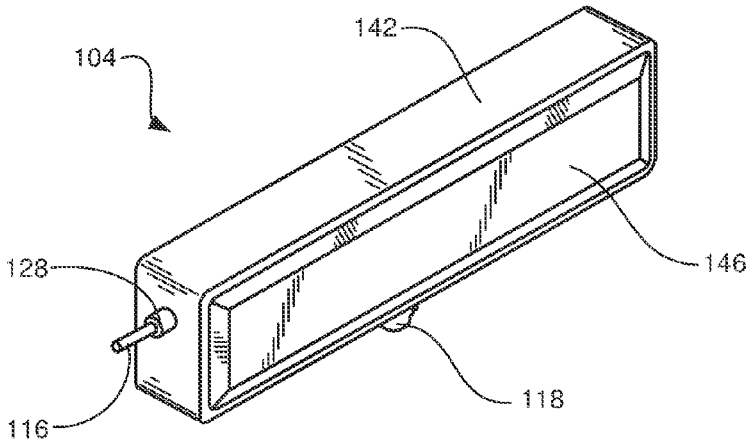
FIG. 5
FIG. 6
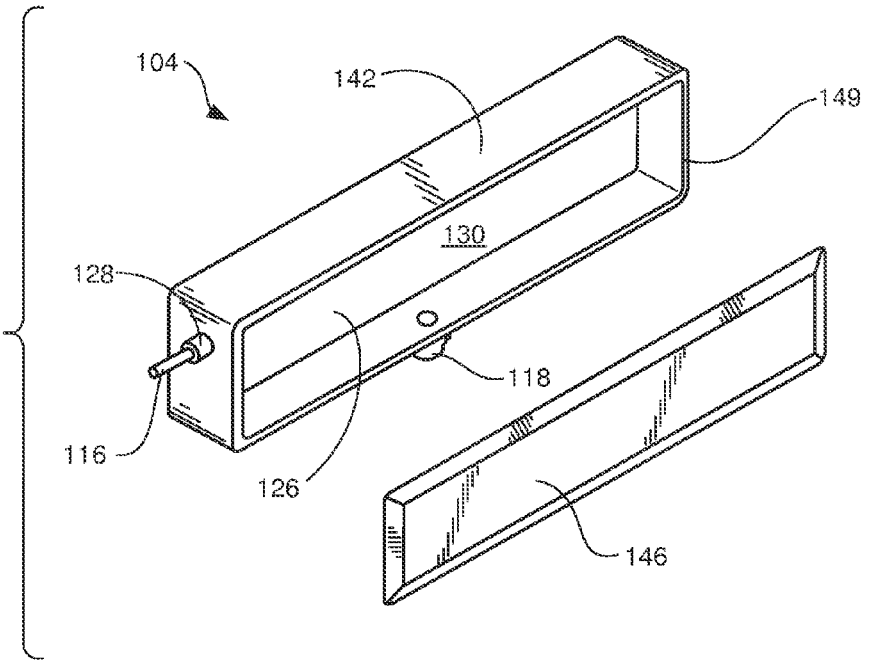

METALLIZED PRINT HEAD CONTAINER AND METHOD

CROSS-REFERENCE TO RELATED APPLICATION

This application is a divisional of co-pending U.S. application Ser. No. 11/714,968, filed Mar. 7, 2007, which is incorporated by reference herein in its entirety.

BACKGROUND

One challenge posed by ink delivery systems for inkjet printers is air accumulation in the ink. When ink bubbles accumulate in the ink delivery system or in the print head, these bubbles can clog ink passageways and nozzles, thus harming print quality or preventing ink ejection altogether in at least part of the print head.

Air accumulation via permeation is one mode by which air can accumulate in an inkjet ink delivery system. The print head ink-containing structure of an inkjet printer is typically a container made of lightweight polymer materials, which can be relatively permeable to air. Even where degassed ink is initially provided in the ink system, air can permeate through the polymer material of the ink reservoir wall over time, and dissolve into the ink. This dissolved air can produce bubbles and ultimately lead to failure of the print head.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein:

FIG. 5 is a fully assembled perspective view of the print head container shown in FIG. 3;

FIG. 6 is an exploded perspective view of the print head container of FIG. 5;

DETAILED DESCRIPTION

Figure 1:
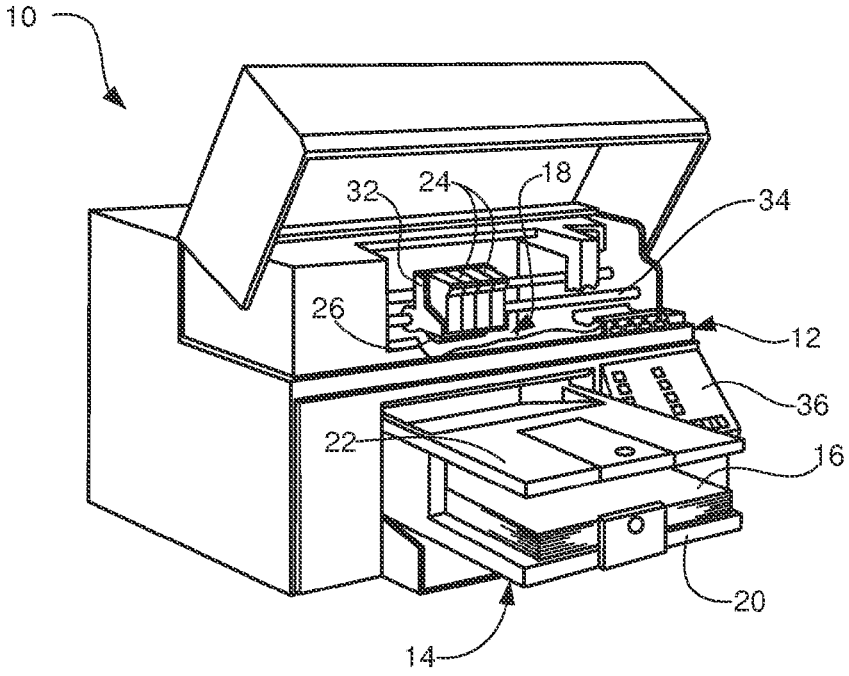
FIG. 1 is a perspective view of one embodiment of an inkjet printing system having moveable print heads, that can incorporate a metallized print head container in accordance with the present disclosure.

Reference will now be made to exemplary embodiments illustrated in the drawings, and specific language will be used herein to describe the same. It will nevertheless be understood that no limitation of the scope of the present disclosure is thereby intended. Alterations and further modifications of the inventive features illustrated herein, and additional applications of the principles of the present disclosure as illustrated herein, which would occur to one skilled in the relevant art and having possession of this disclosure, are to be considered within the scope of the present disclosure.

Inkjet printers have been developed with both fixed and moving print heads. One example of an inkjet printing system having moving print heads is shown in FIG. 1. The printing system 10 generally includes a chassis 12 and a print medium handling system 14 for supplying print media 16 to the printer. The print media can be any of numerous types of suitable sheet material, such as paper, card-stock, transparencies, foils, etc., depending upon the application. The print media handling system moves the print media into a print zone 18 from a feed tray 20 to an output tray 22, such as by a series of conventional motor-driven rollers (not shown).

In the print zone 18 the print media sheets receive ink from one or more print heads that are part of inkjet pen cartridges 24. The printing system shown in FIG. 1 employs a group of 4 discrete pen cartridges, which can include, for example, a black pen cartridge, and three color pen cartridges, allowing full color printing. Alternatively, a tri-color pen can be used with a monochrome black ink pen, or a single monochrome black pen may be used alone. Other alternatives can also be used.

The pen cartridges 24 are transported by a carriage 32, which can be driven along a guide rod 34 by a conventional drive belt/pulley and motor arrangement (not shown). The carriage moves back and forth above print media, such as paper, which is advanced by a paper feeding mechanism. The pen cartridges each include an ink ejection die 26. The pen cartridge and ink ejection die assembly are collectively referred to as the "print head." The ink ejection die includes one or more orifice plates having a plurality of inkjet nozzles (not shown), formed therein, in a manner well known to those skilled in the art. Disposed within each nozzle is an energy-generating element (e.g. a thermal resistor or piezoelectric ejector, not shown) that generates the force necessary for ejecting ink droplets from the nozzle toward the print media. The print head assembly includes ink passageways that communicate with a substrate that is attached to the back of the orifice plate. The pens selectively deposit one or more ink droplets on a sheet of print media 16 in accordance with signals received via a conductor strip (not shown) from a printer controller, such as a microprocessor (not shown) located within the chassis 12. The printer controller is configured to operate in response to input from a computer or other digital device, or from user inputs provided through a keypad 36.

The pen cartridges 24 shown in FIG. 1 can each include reservoirs for storing a supply of ink therein. Where the ink supply is carried within pens that are mounted on the carriage 32, this is referred to as "on-board" or "on-axis" ink supply. In these systems the ink reservoir is integral with the print head, such that the entire pen cartridge and print head is replaced when ink is exhausted. Alternatively, printers can also have moving pens that are connected to stationary ink supplies, and only contain a relatively small amount of ink in an ink container in the print head as the ink passes through from the ink supply to the inkjet nozzles. This configuration is called "off-axis" printing and allows the ink supply to be replaced as it is consumed, without requiring the frequent replacement of the costly pens.

Figure 2:
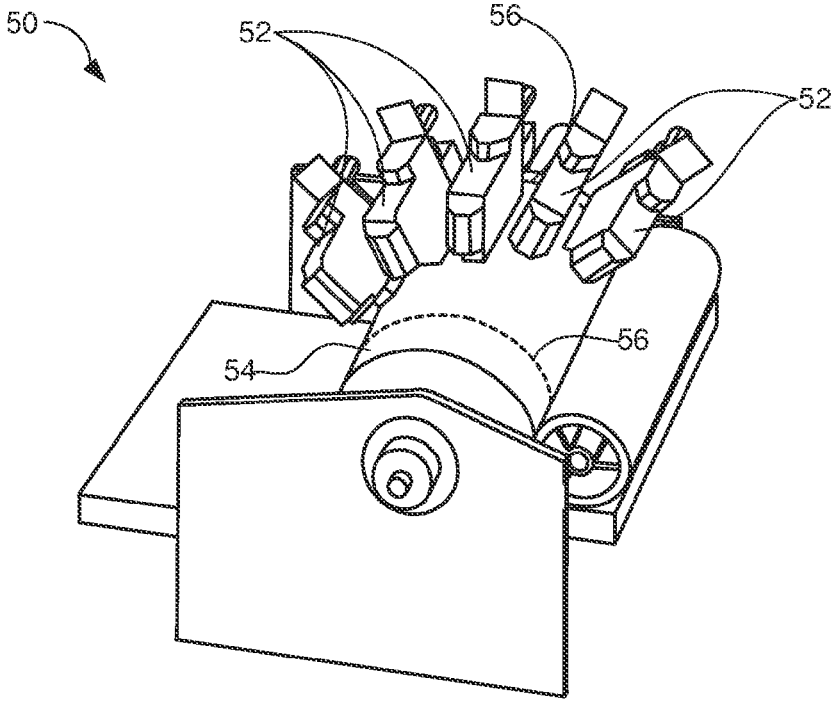
FIG. 2 is a perspective view of an embodiment of an inkjet printing system having fixed print heads, that can incorporate a metallized print head container in accordance with the present disclosure.

As an alternative to moving print heads, inkjet printers having fixed print heads have also been developed. The working components of one example of this type of printer are shown in FIG. 2. In this printer system 50, fixed pens 52 are arrayed adjacent to a rotatable drum 54, upon which paper or other print media is held (e.g. by vacuum pressure) in a print zone on the drum, the print zone being delineated by dashed lines 56. The multiple pens are arranged to cover different portions of the print zone (measured from side to side), so that as the drum rotates (either in one direction only, or in two directions), ink can be ejected onto all desired portions of the print media.

Figure 3:
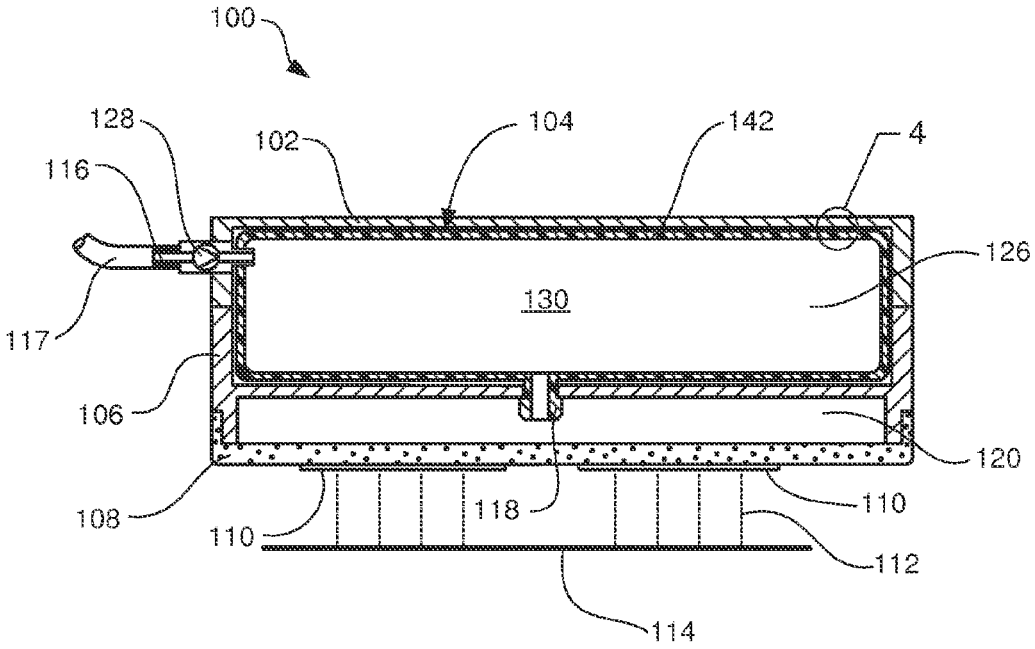
FIG. 3 is a cross-sectional view of one embodiment of an inkjet print head having a metallized print head container.

Whether the print heads are fixed or moveable, they operate in the manner explained above, with an orifice layer having a plurality of nozzles with ink ejection devices that selectively eject ink onto the print media. Provided in FIG. 3 is a cross-sectional view of one embodiment of an inkjet print head that can be used in either fixed or moving print head systems. This print head 100 generally includes a cover 102, a regulator body 104, a carrier 106 and a ceramic layer 108 that supports a plurality of orifice layers or dies 110 that eject ink droplets 112 onto print media 114 located therebelow.

Extending through the cover 102 and into the regulator body 104 is an ink inlet 116. The ink inlet is configured to be connected to an ink conduit or tube 117 that connects to an "off-axis" ink reservoir and pump system (not shown) for supplying ink to the print head. While the print head shown in FIG. 3 is configured for an off-axis ink supply, it could also be modified to have an on-board ink supply. At the bottom of the regulator body is an ink outlet nozzle 118 that directs ink into an ink passageway 120 in the carrier 106, that in turn leads to corresponding passageways (not shown) in the ceramic layer 108, that direct the ink to the ink ejection nozzles in the various orifice layers 110.

The ceramic layer 108 includes electrical paths and electronic structure that connect the print head dies 110 to the print head control circuitry (not shown), which in turn is connected to the printer controller. The number of dies that can be supported by a single print head can vary. In some printing systems having a moveable pen carriage, each print head may have only one die with one associated set of nozzles. In the cross-sectional view of FIG. 3, two dies are shown supported on the ceramic layer, though this is for purposes of clarity only. The print head embodiment shown in this figure can support more than two dies, and each die can include multiple sets of orifices. Other configurations and numbers of dies can be associated with a single print head.

As shown in FIG. 3, the regulator body 104 generally includes a low pressure ink chamber 126 that receives ink from the ink inlet 116 through a pressure regulator valve 128. Ink is pumped through the ink conduit 117 and to the ink inlet 116 from the ink reservoir and pumping system mentioned above. Consequently, the fluid pressure in the ink conduit will be a relatively high pressure (i.e. above atmospheric pressure). However, inkjet printing systems are generally configured to maintain a slight vacuum pressure (e.g. −6 in. $H_2O$) in the print head so that ink does not dribble out of the print head nozzles. For example, in one inkjet printing system, the pressure at the print nozzles is maintained at a pressure in the range of from 0 to −10 inches $H_2O$ (i.e., between 0 and −0.36 psi). This is only one example of an inkjet pressure range, and other pressure ranges can also be used.

In order to maintain the desired lower pressure in the low pressure chamber 126, the regulator valve 128 is configured to open to allow ink to flow into the low pressure chamber only when the fluid pressure in the low pressure chamber drops below some low pressure threshold. As ink flows through the regulator valve and into the low pressure chamber, the fluid pressure in the low pressure chamber will rise. Accordingly, the low pressure chamber can have a maximum allowable pressure which becomes a high pressure threshold. If pressure in the chamber exceeds this value, ink can begin to dribble out of the print heads. When the pressure in the low pressure chamber reaches the high pressure threshold, the regulator valve will close. In order to maintain the desired negative pressure in the low pressure chamber, the high pressure threshold will be some level that is above the low pressure threshold, but still at or below atmospheric pressure.

Viewing FIGS. 5 and 6, the low pressure chamber 126 can be enclosed on one side by a flexible film 146 that can be thermally staked to the edge or rim 149 of the low pressure chamber. As ink is withdrawn from the low pressure chamber during printing, the volume of ink in the low pressure chamber will drop, as will the pressure in that chamber. Consequently, atmospheric pressure from outside the regulator body will tend to push the flexible film inwardly. Conversely, when ink from the ink conduit 117 and inlet 116 (on the other side of the regulator valve) flows into the low pressure chamber, the pressure will increase and the flexible film will be pushed back out. This allows the ink volume and pressure in the low pressure chamber to vary, while maintaining the desired negative pressure and avoiding air bubbles in the low pressure chamber.

The flexible film 146 can be a high barrier flexible laminate material. As used herein, the term "high barrier" refers to materials that have relatively low permeability to air. For example, a three layer laminate comprising two layers of polyethylene (PE) with a layer of EVOH bonded therebetween can be used as a high barrier flexible film. The PE layers allow the film to be securely staked (i.e. thermally bonded) to the regulator body (e.g. also of polyethylene) around the perimeter of the low pressure chamber 126. With this arrangement the film provides a high barrier by virtue of the EVOH layer, and there are no edges of the film material that are in contact with ink in the low pressure chamber, as can be the case with an immersed accumulator bag.

Figure 7:
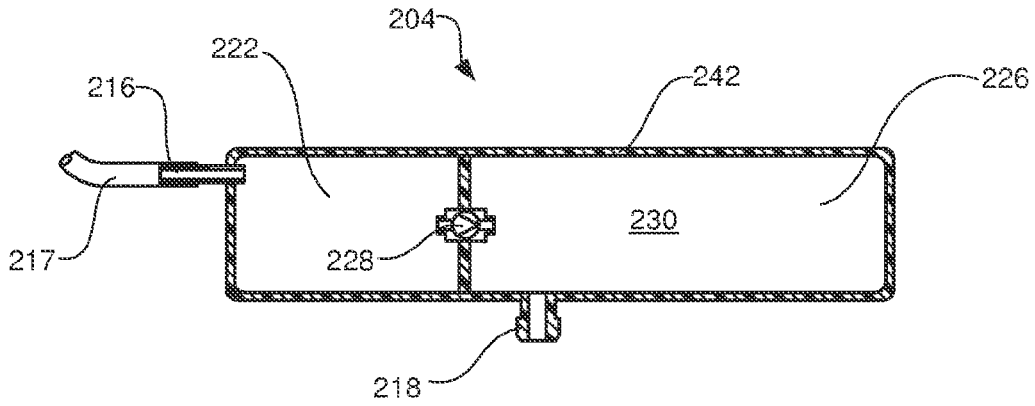
FIG. 7 is a cross-sectional view of another embodiment of a metallized print head container.
Figure 8:
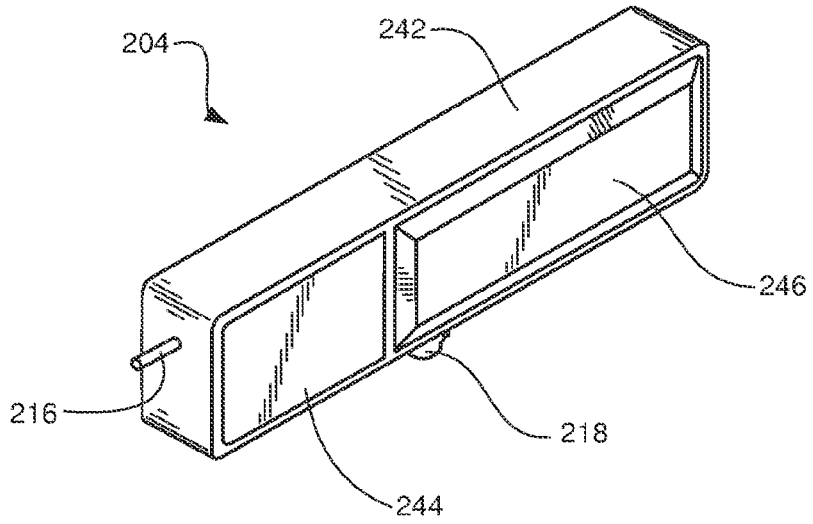
FIG. 8 is a fully assembled perspective view of the print head container of FIG. 7.
Figure 9:
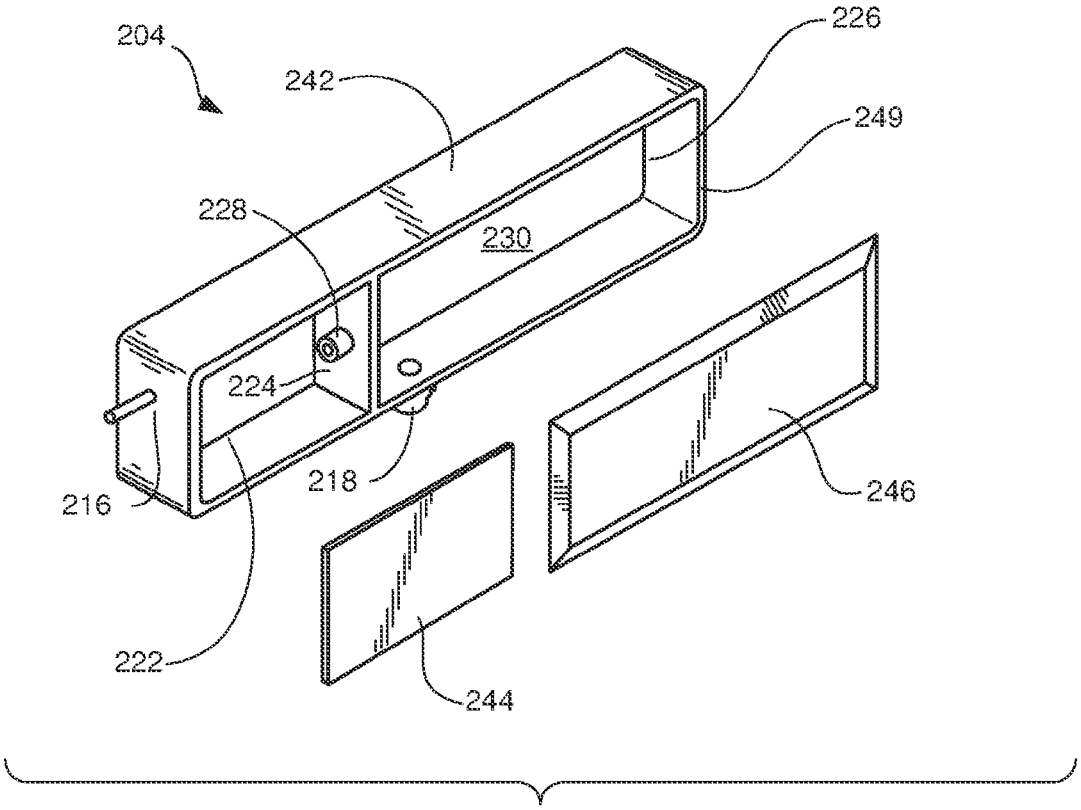
FIG. 9 is an exploded perspective view of the print head container of FIG. 8.

Another embodiment of a print head ink container 204 is shown in FIGS. 7-9. As shown in the cross-sectional view of FIG. 7, this embodiment includes both a high pressure chamber 222 and a low pressure chamber 226, separated by a barrier wall 224 therebetween. Unlike the embodiment of FIG. 3, the ink inlet 216 feeds directly into the high pressure chamber, and does not include a pressure regulator valve (128 in FIG. 3). Consequently, the high pressure chamber can be viewed as essentially an extension of the ink conduit 217, since the fluid pressure in the high pressure chamber will be substantially the same as that in the ink conduit.

A pressure regulator valve 228 is positioned in the barrier wall between the high and low pressure chambers, and serves the function of controlling the flow of ink into the low pressure chamber. When ink pressure in the low pressure chamber reaches the low pressure threshold, the regulator valve will open and allow ink to flow from the high pressure chamber into the low pressure chamber. When fluid pressure in the low pressure chamber reaches the high pressure threshold, the regulator valve will close so that pressure in the low pressure chamber will not continue to increase. The two chamber configuration of FIG. 7 thus allows regulation of the ink pressure and flow in a manner similar to the configuration of FIG. 3.

With this design, ink that enters the high pressure chamber 222 will pass through the regulator valve 228 and into the low pressure chamber 226, from which it will exit via the outlet 218, and thence into the ink passageway 220 in the carrier 206, which leads to other portions of the ceramic layer and nozzles in the print head die(s) 210. Viewing FIGS. 8 and 9, a relatively rigid high pressure chamber cover 244 is provided to cover and seal the high pressure chamber, while a flexible film 246 can be thermally staked to the exposed edge or rim 249 of the low pressure chamber. The flexible film functions in the manner described above with respect to FIGS. 3-6, and allows the pressure and volume of ink in the low pressure chamber to vary over time. It is to be understood that the configuration of the regulator body 204 with high and low pressure chambers is only one of many possible configurations for a print head container that operates in the manner described herein.

The mechanism for actuating the regulator valve 128 in FIG. 3 (or valve 228 in FIG. 7) is not shown in the figures. However, there are a variety of ways in which this can be done. For example, the regulator valve can be electronically actuated in response to signals from one or more pressure sensors (not shown) within the low pressure chamber 126. Other electrical and/or mechanical systems for detecting pressure within the low pressure chamber and actuating the regulator valve can also be used, as will be apparent to those of skill in the art.

In some prior inkjet systems the desired negative pressure range is mechanically maintained by an accumulator bag of flexible, high barrier polymer material (such as EVOH, Ethylene-Vinyl Alcohol Copolymer) that is immersed in a rigid walled, low pressure ink chamber in the print head. The accumulator bag is sealed from the ink and in fluid communication with the atmosphere, and inflates or deflates in response to pressure changes in the low pressure ink chamber. Mechanical springs are often attached to compress the accumulator bag, so that the volume of the bag at any given time is smaller than it would ordinarily be under atmospheric pressure, thus allowing the volume of the low pressure ink chamber to be larger than it would be under those conditions, and keeping the ink fluid pressure below atmospheric pressure.

The desired vacuum pressure in the print head ink is one factor that leads to air accumulation in the print head. With pressure that is below atmospheric pressure, air that is dissolved in the ink can come out of solution and create bubbles in the system, having the effects discussed above. Additionally, the regulator body 104 or other ink-containing structure in an inkjet print head is typically molded of polypropylene, polyethylene, or other lightweight polymer that is relatively permeable to air. The thickness of this body is typically in the range of 1 to 3 mm.

Figure 10:
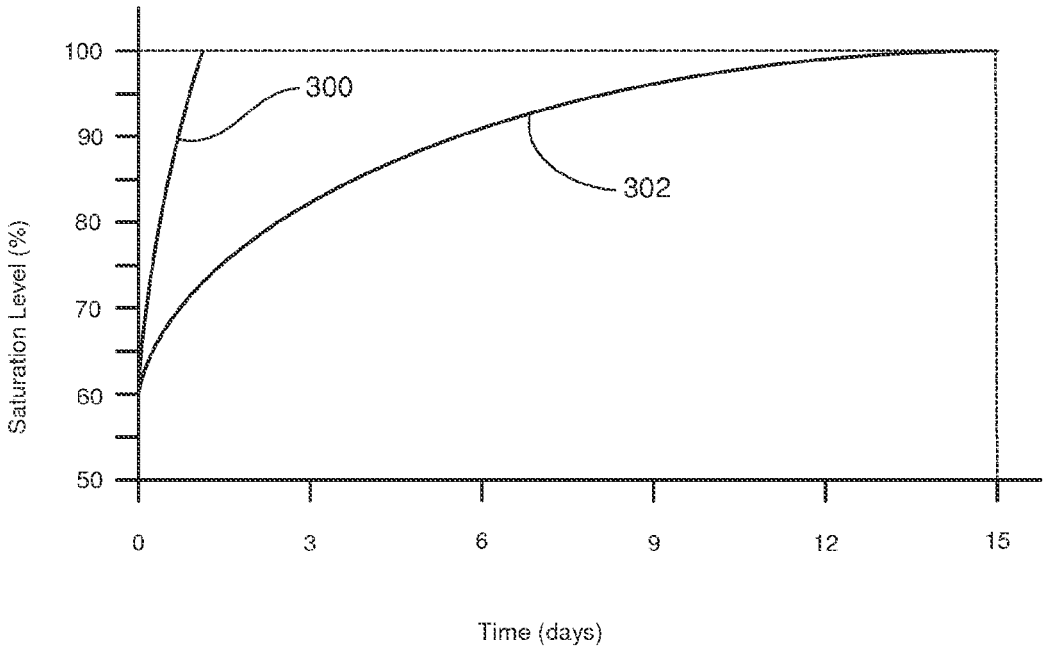
FIG. 10 is a graph of air saturation versus time for ink contained in both high barrier and low barrier print head containers.

Air permeation is a function of pressure, temperature, time, surface area, and the thickness and permeability of the material. Polypropylene and polyethylene typically have air permeability rates that range from about 150 to 500 ((cc)(0.001 in.))/((100 $in^2$)(atm.)(day)). This level of permeability is considered moderate to high. At this rate of air permeation, the ink in a print head low pressure ink chamber can attain full saturation in about one day when contained in a 1-3 mm thick polypropylene body. This phenomenon is illustrated in FIG. 10, which shows the air saturation curve 300 for ink in such an ink reservoir rising from about 60% to 100% in about one day. Even where degassed ink is supplied to the print head initially, the ink can relatively quickly resaturate. Additionally, an immersed accumulator bag can provide additional avenues for air permeation into the ink supply.

Some approaches to air accumulation in print head ink supplies have focused on trapping and redirecting air bubbles away from the print head orifice layers. Other approaches have involved constructing the print head ink-containing structure of high air barrier polymer materials, such as LCP (liquid crystal polymer), PET (polyethylene terephthalate) or PEI (polyetherimide). These high barrier materials are often more expensive than less permeable alternatives, and can have other undesirable performance characteristics, such as brittleness, undesirable molding and joining properties, strength problems and cracking issues. Joining some hard, high barrier plastics can involve the use of gaskets, adhesives, or in some cases employing a welding process.

Advantageously, the inventors have developed a print head pressure regulator system that helps to reduce air permeation into the print head. The inventors' approach is simple, robust, and uses relatively low cost materials and few parts to maintain low pressure in the print head ink supply.

The following discussion of the inventor's approach will make specific reference to the embodiment shown in FIGS. 3-6, but it is to be understood that the discussion also applies to the embodiment shown in FIGS. 7-9. Referring to FIG. 3, the inventors have found that metalizing or metal-coating the exterior surfaces of the regulator body 104 significantly reduces its permeability to air, and allows the continued use of low cost polymer materials, such as polypropylene or polyethylene, which have desirable properties (e.g. strength, ductility, moldability, ease of use, etc.) over a broad range of requirements. In this approach, the regulator body is first molded (e.g. injection molded) of the desired polymer material, and the surfaces to be metal coated are then plasma treated to promote adhesion of the metal coating. The body is then placed in a vacuum deposition chamber, where one or more layers of metal are deposited onto any exposed surfaces through a chemical vapor deposition process. Such processes are well known to those skilled in the art.

Figure 4:
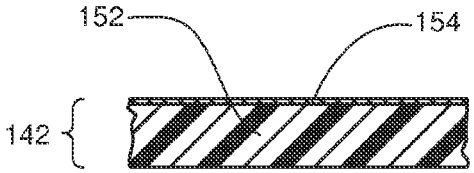
FIG. 4 is a close-up cross-sectional view of the metallized wall of the print head container of FIG. 3.

A close-up cross-sectional view of a portion of the metallized or metal-coated sidewall 142 of the regulator body 104 is shown in FIG. 4. In this view it can be seen that the sidewall comprises a base polymer wall layer 152 and a relatively thin metal layer 154. The thickness of the metal layer is greatly exaggerated in this view for illustrative purposes. The metal layer greatly decreases the permeability of the print head body, while the underlying polymer material retains the desirable characteristics of strength, ductility, moldability, good film staking properties, and so forth.

A variety of materials can be used for the metal layer. Most metals can be used, including aluminum, copper, silver, gold, nickel, stainless steel, etc. These can be applied in multiple layers. For example, in one embodiment, after plasma treatment, the inventors coated via vacuum deposition a polypropylene body with a first layer of copper, and a second layer of aluminum. The inventors also believe that the provision of a stainless steel layer atop a copper layer can be used. It is also believed that other types of metal coatings can be used, such as paint materials that contain metal flakes or powder. A clear coat (e.g. clear enamel) can also be applied to the final metal layer to reduce oxidation of the metal layer if desired.

The thickness of the metal layer(s) can vary. The inventors believe that a metal coating having a total thickness in the range of from 1-10 microns is suitable, with a range of 3-6 microns being a likely range. This total thickness can be made up of multiple individual metal layers that can be from 1-3 microns or more in thickness. It is to be understood that metal layers having a total thickness of greater than 10 microns can also be used. As noted above, permeability of a material is in part a function of the thickness of the material. While metals are substantially less permeable than polymers such as polypropylene and polyethylene, if the metal layer is too thin it may not provide the desired reduction in permeability. On the other hand, once the thickness of the metal layer increases beyond a certain point, there may be relatively little additional reduction in permeability for each incremental increase in thickness.

In testing of one embodiment, the inventors coated via vacuum deposition a molded polypropylene box having a physical shape and size similar to that of the regulator body 104 shown in FIG. 3, and having walls approximately 1 mm thick, with a two layer metal coating comprising a first layer of copper, and a top layer of aluminum. The total metal coating thickness was approximately 5 microns. Pressure regulating equipment was loaded into the container, and a lid of similarly metal-coated polymer was then sealed in place. In subsequent pressure testing, the air barrier performance of the coated container was found to be better than uncoated polypropylene of the same type by a wide margin.

The following table summarizes the pressure testing results of the metal-coated container compared to an uncoated but otherwise identical polypropylene (PP) container, with permeability expressed in units of cc/atm-day.

| Part No. | PP only | Metallized |
|---|---|---|
| 1 | 0.39 | 0.03 |
| 2 | 1.72 | 0.02 |
| 3 | 0.34 | 0.01 |

Figure 11:
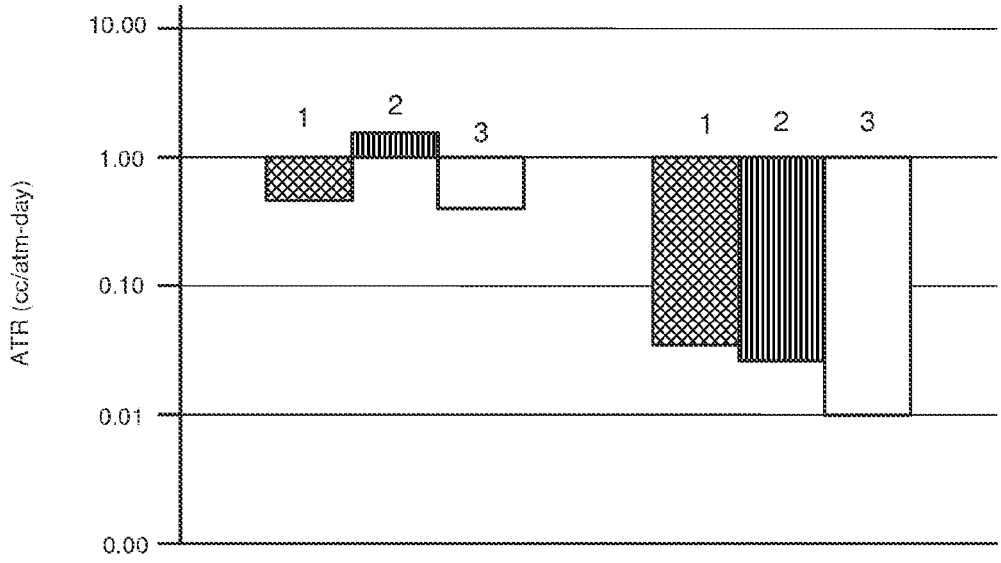
FIG. 11 is a bar chart of air permeability rates for three sample print head containers tested both before and after metallization.

These results are shown graphically in the bar chart of FIG. 11, which provides the permeability measurements on a logarithmic scale. It is believed that the one outlying data control point (for Part no. 2, PP only) came from a test container that had a leak, and represents experimental error. With the removal of this outlying data point, the average decrease in permeability of the test containers after metallization was by a factor of about 17.

This change in permeability is similar to the long curve 302 shown in the graph of FIG. 10. The curves in FIG. 10 were determined experimentally from air permeation tests of high barrier polymer materials (such as LCP, PET, PEI, etc.) and low barrier materials (such as polypropylene and polyethylene), respectively. The air saturation curve 302 for the high barrier materials shows that degassed ink contained in such a container will not reach saturation until after about 15 days, as opposed to about one day for the low barrier material. Considering this graph in view of the results in the table above and shown in FIG. 11, it is apparent that the decrease in permeability provided by the metallized low barrier material is comparable to or better than that provided by the high barrier material. The inventors thus believe that a metal-coated print head container in accordance with the present disclosure can have a permeability decrease by at least a factor of 10. A permeability decrease by a factor of 15 or 17 is also possible.

The portions of the regulator body that can be metal coated can vary. With respect to the embodiment of FIGS. 3-6, when fully assembled, the portions of the regulator body 104 that are exposed are the sidewalls 142, the flexible film 146, and the exterior of the back wall 130. In the embodiment of FIGS. 7-9, the portions of the regulator assembly 204 that are exposed after assembly are the sidewalls 242, the high pressure chamber cover 244 that seals the high pressure chamber 222, the exterior of the back wall 230, and the flexible film 246 that seals and covers the low pressure chamber 226.

In one approach, only the perimeter surfaces are metal coated. As used herein, the term "perimeter surface" is intended to refer to all external surfaces of the regulator body except the external surface of the flexible film. In the embodiment of FIGS. 3-6, the perimeter surface includes the four sidewalls 142 of the regulator body (visible in cross-section in FIG. 3), plus the exterior of the back wall 130 of the regulator body. In the embodiment of FIGS. 7-9, the perimeter surface includes the sidewalls 242, and the exterior of the back wall 230.

To provide the desired metal coating, the portions of the unassembled regulator body that are not to be metal coated are masked (e.g. the low pressure chamber 126 in the embodiment of FIG. 3, or both the low and high pressure chambers 222, 226 in the embodiment of FIG. 7), and the regulator body is placed in a vacuum deposition chamber and coated with the desired coat(s) of metal. The masking is later removed to allow the flexible film 146 (246 in FIGS. 8, 9) to be attached, such as by thermal staking. In the embodiment of FIGS. 7-9, the high pressure chamber cover 244 can also be attached after metallization of the regulator body. The high pressure chamber cover can be of a high barrier polymer material, or include one or more high barrier layers. Since the flexible film 246 is also a high barrier material, the low permeability of the regulator body is maintained.

Alternatively, the fully assembled regulator body can be metal coated in its entirety in the manner described above. That is, considering the embodiment of FIGS. 3-6, the regulator body 104 is placed in the vacuum deposition chamber after the flexible film 146 is attached to the body, so that the perimeter surface and the exterior of the flexible film (i.e. substantially all surfaces that are exposed in the configuration of FIG. 5) are metal coated. Likewise, with the configuration shown in FIGS. 7-9 the regulator body 204 with the flexible film 246 and high pressure chamber cover 244 attached can be placed in the vacuum deposition chamber, so that the perimeter surface and both the exterior of the flexible film and of the high pressure chamber cover (i.e. substantially all surfaces that are exposed in the configuration of FIG. 8) are metal coated. This approach can help prevent any exposed portions of the regulator body from not getting properly metal coated, which can occur when only the perimeter is metallized if the geometry of the mask is flawed, for example.

In the metallized print head container disclosed herein, air accumulation is minimized without the use of exotic high barrier materials. By coating polypropylene, for example, with a metallization, the other advantages of polypropylene (ability to form stake joints, moldability, low cost, etc.) are retained, while the air barrier properties are significantly improved. The result is a print head container material option that performs well over a broad range of requirements, providing a low cost, simple assembly that meets the design requirements for an inkjet printing container. The associated method of containing ink is advantageous because there are fewer parts in the print head assembly, fewer joints, and lower cost materials.

It is to be understood that the above-referenced arrangements are illustrative of the application of the principles of the present disclosure. It will be apparent to those of ordinary skill in the art that numerous modifications can be made without departing from the principles and concepts of the present disclosure as set forth in the claims.

What is claimed is:

1. An ink container for an inkjet print head, comprising:

a substantially rigid body of polymer material, the body including:

a base; and a side wall integrally formed with, and extending outwardly from the base around a perimeter of the base, the side wall having an exposed edge distal to the base, wherein the base and the side wall define a low pressure chamber, the body containing ink in the low pressure chamber, and the polymer material having moderate to high air permeability;

a flexible film, sealed at the side wall exposed edge over the low pressure chamber, inwardly flexible in response to a decrease in pressure and ink volume in the low pressure chamber, and outwardly flexible in response to an increase in pressure and ink volume in the low pressure chamber; and a metal coated on a perimeter of the polymer body and on an outer exposed surface of the flexible film, the metal to form a metal coating configured to decrease the air permeability of the polymer body, the metal coating being formed from at least copper;

wherein the metal coating includes multiple layers.

2. The ink container in accordance with claim 1 wherein the metal coating is additionally formed from at least one material selected from the group consisting of aluminum, silver, gold, nickel and stainless steel.

3. The ink container in accordance with claim 1 wherein the thickness of the metal coating is in the range from 1-10 microns.

4. The ink container in accordance with claim 1 wherein the metal coating reduces air permeability of the body by a factor of at least about 15.

5. The ink container in accordance with claim 1, further comprising a pressure regulator valve to selectively allow ink to flow into the low pressure chamber from a higher pressure source.

6. The ink container in accordance with claim 1 wherein the flexible film comprises a high barrier polymer film, thermally staked to the polymer body at the side wall exposed edge.

7. The ink container in accordance with claim 1 wherein the polymer body is of a material selected from the group consisting of polypropylene and polyethylene.

8. The ink container in accordance with claim 1, further comprising a cover and a carrier that, in combination, encloses the metal coated on the perimeter of the polymer body and on the outer exposed surface of the flexible film.

9. The ink container in accordance with claim 1 wherein the polymer body is formed from a single piece of the polymer material.

10. The ink container in accordance with claim 1 wherein the polymer body is formed from polypropylene.

11. The ink container in accordance with claim 1 wherein the polymer body is formed from polypropylene, and wherein the metal coating includes a copper layer disposed on the polypropylene polymer body, and an aluminum layer disposed on the copper layer, the total metal coating thickness of both layers being about 5 microns.

12. The ink container in accordance with claim 11 wherein the metal coating reduces air permeability of the polymer body by a factor of about 17.

13. The ink container in accordance with claim 1 wherein the multiple layers of the metal coating include a first layer disposed on the polymer body and a second layer disposed on the first layer, the first layer being formed from a first metal, and the second layer being formed from a second metal that is different from the first metal.

14. The ink container in accordance with claim 13 wherein the first metal is copper, and the second metal is stainless steel.

15. An ink container for an inkjet print head, comprising:

a substantially rigid body of a polymer material selected from the group consisting of polypropylene and polyethylene, the body including:

a base;

a side wall integrally formed with, and extending outwardly from the base around a perimeter of the base, the side wall having an exposed edge distal to the base; and a barrier wall having a bottom edge, a top edge distal thereto, and two opposed sides, the bottom edge being attached to the base, and the two opposed sides being attached to respective opposed inner surfaces of the side wall, wherein the barrier wall, the base, and the side wall define a low pressure chamber and a high pressure chamber, with the barrier wall extending therebetween, the body containing ink in the low pressure chamber and the high pressure chamber, and the polymer material having moderate to high air permeability;

a flexible film, sealed at the side wall exposed edge and the barrier wall top edge over the low pressure chamber and not over the high pressure chamber, the flexible film inwardly flexible in response to a decrease in pressure and ink volume in the low pressure chamber, and outwardly flexible in response to an increase in pressure and ink volume in the low pressure chamber; and a metal coated on a perimeter of the polymer body and on an outer exposed surface of the flexible film, the metal to form a metal coating configured to decrease the air permeability of the polymer body, the metal coating being formed from at least copper;

wherein the high pressure chamber has no flexible film thereover.

16. The ink container in accordance with claim 15, further comprising a substantially rigid cover attached to the high pressure chamber, the high pressure chamber having no flexible film disposed between the high pressure chamber and the substantially rigid cover, wherein the metal is additionally coated on the substantially rigid high pressure chamber cover.

17. The ink container in accordance with claim 15 wherein the metal coating is additionally formed from at least one material selected from the group consisting of aluminum, silver, gold, nickel and stainless steel.

18. The ink container in accordance with claim 15 wherein the metal coating comprises multiple layers.

19. The ink container in accordance with claim 18 wherein the polymer body is formed from polypropylene, wherein the metal coating includes a copper layer disposed on the polypropylene polymer body, and an aluminum layer disposed on the copper layer, the total metal coating thickness of both layers being about 5 microns, and wherein the metal coating reduces air permeability of the polymer body by a factor of about 17.

20. The ink container in accordance with claim 15 wherein the polymer body is formed from polypropylene.

* * * * *